US006375603B1

(12) United States Patent
Yuasa et al.

(10) Patent No.: US 6,375,603 B1
(45) Date of Patent: Apr. 23, 2002

(54) BAG FOR PACKING POWDER, METHOD OF PRODUCING THE SAME AND METHOD OF PRODUCING FILM HAVING HOLES CONSTITUTING THE BAG

(75) Inventors: Haruo Yuasa; Isao Hata, both of Yokkaichi; Motoyuki Esaki; Hiroshi Suizu, both of Tokyo; Tatsuo Yamazaki, Sagamihara, all of (JP)

(73) Assignees: Mitsui Chemicals, Inc., Tokyo; Tokiwa Sangyo Co., Kanagawa, both of (JP)

( * ) Notice: Subject to any disclaimer, the term of this patent is extended or adjusted under 35 U.S.C. 154(b) by 0 days.

(21) Appl. No.: 09/545,680

(22) Filed: Apr. 7, 2000

(30) Foreign Application Priority Data

Apr. 9, 1999 (JP) ..... 11-102780

(51) Int. Cl.[7] ..... B31B 1/80; B65D 81/26

(52) U.S. Cl. ..... 493/256; 206/204; 206/484.1; 383/103

(58) Field of Search ..... 206/204, 439, 206/484.1; 383/45, 100–103; 428/34.9, 35.1, 35.2, 35.5; 493/186, 210, 256, 313, 925

(56) References Cited

U.S. PATENT DOCUMENTS 3,628,720 A * 12/1971 Schmedding ..... 383/103
4,550,546 A * 11/1985 Raley et al. ..... 206/484.1
4,572,360 A * 2/1986 Lischka, geb. Woitzik . 383/100
5,804,265 A * 9/1998 Saad et al. ..... 383/100

FOREIGN PATENT DOCUMENTS

EP 0409535 A1 1/1991

OTHER PUBLICATIONS

Patent Abstracts of Japan, 06330443, Nov. 29, 1994.
Patent Abstracts of Japan, 08245818, Sep. 24, 1996.

* cited by examiner

*Primary Examiner*—Luan K. Bui
(74) *Attorney, Agent, or Firm*—Birch, Stewart, Kolasch & Birch, LLP

(57) ABSTRACT

A bag for packing powder, permeable for gases and comprising a plurality of inwards protrudent hole-forming portions. Preferably, the bag comprises a film having holes (B) of predetermined thickness (d) furnished with protrudent hole-forming portions of predetermined height (h), the height (h) of the protrudent hole-forming portions being in the range of 2 to 200, still preferably 5 to 100, times the thickness (d) of the film having holes (B). By virtue of this structure, the soaring of powder at the time of powder filling can be prevented to thereby facilitate the filling operation. Furthermore, not only is the sticking of powder to seal portion reduced at the time of sealing the mouth of the bag to thereby ensure obtaining satisfactory seal strength but also the environmental pollution by the soaring of powder can be avoided.

5 Claims, 4 Drawing Sheets

BAG FOR PACKING POWDER, METHOD OF PRODUCING THE SAME AND METHOD OF PRODUCING FILM HAVING HOLES CONSTITUTING THE BAG

FIELD OF THE INVENTION

The present invention relates to a bag for packing, for example, an oxygen scavenger composed of an oxygen adsorbing substance, a carbon dioxide release agent composed of a substance capable of releasing carbon dioxide, a moisture absorbent agent composed of a moisture absorbent substance such as calcium oxide or silica gel, a fragrance preparation including wood powder or the like, a cosmetic powder, a carbon dioxide adsorbent, active carbon, iron powder, paulownia wood ash, zeolite or a highly water absorbent polymer. Further, the present invention relates to a method of producing the above packing bag and a method of producing a film having holes for constituting the packing bag.

BACKGROUND OF THE INVENTION

The packing bags of the above kind must be permeable for gases. Therefore, and in order to cause them to have a certain level of strength, it is common practice to compose them of materials such as a laminate of porous films having micropores or, as shown in FIG. 1, a double layer or triple layer structure comprising any of paper, nonwoven fabric, cloth cotton, etc. (1) sandwiched by porous film (2) and/or (3).

The porous film is generally obtained by thrusting heated needles through a film or spot-wise irradiating a film with laser to thereby attain perforation. In this perforation, no protrusion is formed across the film section (in the direction of the film thickness), and, because the film is passed through compression rolls at the step of combining with, for example, paper for lamination, the surface of the packing bag is smoothed. Moreover, in the method using heated needles, it is likely for the pore configuration to become nonuniform and diversified.

The conventional packing bags have a drawback, at the time of powder filling, such that, the lower the specific gravity of the powder, the greater the disadvantages such as soaring to an extent that filling is difficult, sticking of powder to seal portion to thereby deteriorate the seal strength and environmental pollution by powder soaring.

SUMMARY OF THE INVENTION

The object of the present invention is to provide a bag for packing powder which enables solving these problems, a method of producing the same and a method of producing a film having holes for constituting the packing bag.

The present invention relates to a bag for packing powder, which is characterized by being permeable for gases and comprising a plurality of inwards protrudent hole-forming portions.

In the use of the above packing bag of the present invention, the soaring of powder at the time of filling is inhibited by the protrudent hole-forming portions to thereby avoid soaring problems.

In the present invention, preferably, the packing bag comprises a film (B) having holes provided with protrudent hole-forming portions, the height (h) of the protrudent hole-forming portions being in the range of 2 to 200, still preferably 5 to 100, times the thickness (d) of the film (B) having holes.

Further, the present invention relates to a method of producing a film (B) having holes provided with protrudent hole-forming portions, the film (B) having holes used in the production of the above packing bag, which method comprises the steps of:

disposing a resin film on a metallic cylinder or porous plate furnished with a plurality of openings, and applying a negative pressure suction to the resin film from a back of the metallic cylinder or porous plate, while heating the resin film at its softening point or higher, so that the resin film at the openings is drawn, toward the back of the metallic cylinder or porous plate to thereby provide protrudent hole-forming portions.

In the present invention, it is preferred that the above resin film comprise a plurality of resin layers different from each other, the resin of an outermost layer having a melting point which is at least 5° C. lower than those of other resin layers.

Still further, the present invention relates to a method of producing a bag for packing powder, which method comprising the steps of:

using a composite sheet, which is obtained by laminating the film (B) having holes obtained by the above method with any of paper, cloth cotton or a minutely perforated film (A), and forming said composite sheet into a bag in such a manner that the protrudent hole-forming portions of the film (B) having holes are directed inwards.

Moreover, the present invention relates to a bag for packing powder produced by using a composite sheet, which is obtained by laminating the film (B) having holes Obtained by the above method with any of paper, cloth cotton or a minutely perforated film (A), and forming said composite sheet into a bag in such a manner that the protrudent hole-forming portions of the film (B) having holes are directed inwards.

In a preferred embodiment of the present invention, the bag for packing powder is one produced by using a composite sheet of triple layer structure, which is obtained by disposing the film (B) having holes obtained by the above method, arranged inside, and a minutely perforated film (A), arranged outside, and interposing paper or cloth cotton therebetween, and forming the composite sheet into a bag in such a manner that the protrudent hole-forming portions of the film (B) having holes are directed inwards.

Furthermore, according to the present invention, there is provided a bag for packing powder produced by using a composite sheet of triple layer structure, which is obtained by laminating the film (B) having holes obtained by the above method with both sides of any of paper, cloth cotton and a minutely perforated film (A), and forming the composite sheet into a bag.

DETAILED DESCRIPTION OF PREFERRED EMBODIMENT

A first embodiment of the invention relates to a bag for packing powder, which is characterized by being permeable for gases and comprising a plurality of inwards protrudent hole-forming portions.

In the use of the above packing bag of the present invention, the soaring of powder at the time of filling is inhibited by the protrudent hole-forming portions to thereby avoid soaring problems.

In a second embodiment of the invention, the packing bag comprises a film (B) having holes provided with protrudent hole-forming portions according to the first embodiment of the invention, the height (h) of the protrudent hole-forming portions being in the range of 2 to 200, still preferably 5 to 100, times the thickness (d) of the film (B) having holes.

The thickness is in the range of 5 to 200 $\mu$m, preferably 10 to 100 $\mu$m.

Figure 1:
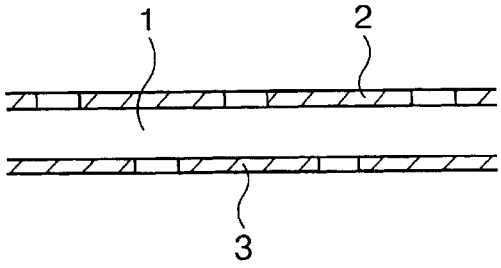
FIG. 1 is a partial sectional view of a sheet for use in the production of the conventional packing bag.
Figure 2:
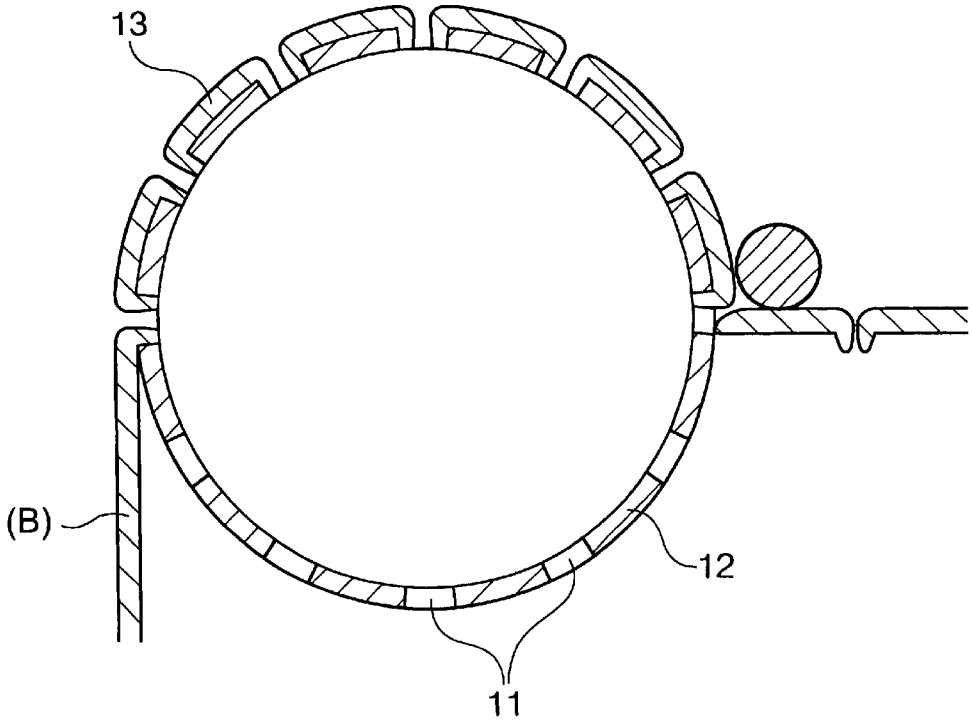
FIG. 2 is a sectional view of an apparatus for use in the production of a film provided with protrudent hole-forming portions.

The protrudent hole-forming portions according to the above inventions can be provided by, for example, the method as disclosed in Japanese Patent Laid-open Publication No. 6(1994)-330443 which comprises passing a film between a pin roll having a plurality of pins and a projected roll fitted with projected disc. Alternatively, the protrudent hole-forming portions can be provided by the method as disclosed in, for example, Japanese Patent Laid-open Publication No. 3(1991)-97458 (EP 409,535) which, as shown in FIG. 2, comprises feeding a resin film 13 onto a metallic cylinder 12 provided with a plurality of openings 11 and applying to the resin film a negative pressure suction from a back of the metallic cylinder, while heating the resin film at its softening point or higher, so that the resin film at the openings is drawn toward the back of the metallic cylinder. Of these methods, the latter one applying suction through a metallic cylinder (porous plate may be used in place thereof) is preferred. The reason is that the hole diameter and hole spacing can be reduced and that the uniformity of hole formation can be enhanced.

Therefore, the third embodiment of the invention relates to a method of producing a film (B) having holes provided with protrudent hole-forming portions, the film (B) having holes used in the production of the packing bag according to the first or second embodiments of the invention, which method comprises the steps of:

disposing a resin film on a metallic cylinder or porous plate furnished with a plurality of openings, and applying a negative pressure suction to the resin film from a back of the metallic cylinder or porous plate, while heating the resin film at its softening point or higher, so that the resin film at the openings is drawn toward the back of the metallic cylinder or porous plate to thereby provide protrudent hole-forming portions.

Figure 3:
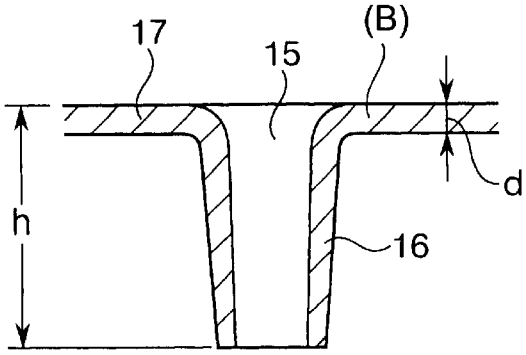
FIG. 3 is a partial enlarged sectional view of a film provided with protrudent hole-forming portions.

As shown in FIG. 3, the present invention provides protrudent hole-forming portions 16 having protrudent holes 15, which have undiversified and uniform configuration.

Figure 4:
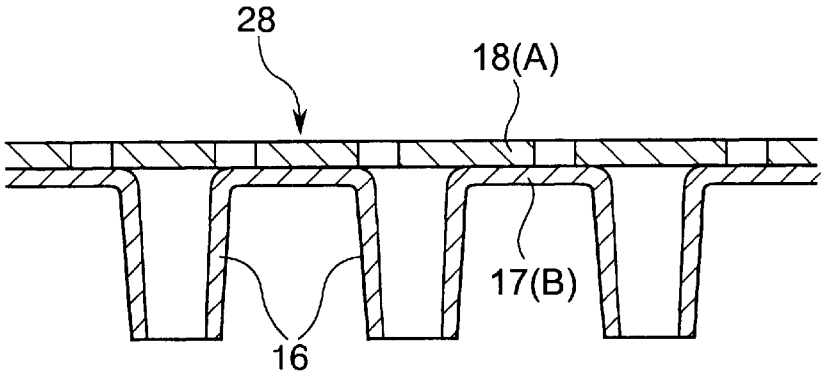
FIG. 4 is a sectional view of a composite sheet of double layer structure.
Figure 5:
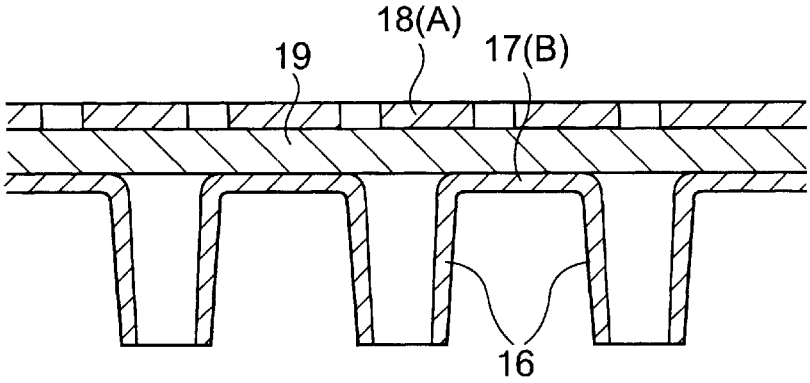
FIG. 5 is a sectional view of a composite sheet of triple layer structure.

Although the film (B) having holes produced by the above method of the present invention can be used in the form of a single layer, it is preferred that, as shown in FIGS. 4 and 5, the film (B) having holes 17 is formed into a double layer or triple layer structure by effecting a lamination with paper or cloth cotton 19 or a minutely perforated film (A) 18, when there is a problem in strength, or when the formed protrudent holes are so large that there is the danger of spilling of charged powder, or when it is desired to lower the gas permeability or attain uniform controlling thereof.

As long as the holes of the film (B) having holes and minutely perforated film (A) are not closed and as long as the configuration of protrusion of the protrudent hole-forming portions of the film (B) having holes is maintained, the lamination of the film (B) having holes with any of paper, cloth cotton and a minutely perforated film (A) can be accomplished by conventional methods. For example, the method in which a hot melt resin is melt applied in dotted or linear form to paper, cloth cotton or a minutely perforated film (A) and stuck to the film (B) having holes, and the dry lamination method. Preferably, the film (B) having holes comprises a plurality of resin layers different from each other, the resin of an outermost layer thereof to be laminated with paper, cloth cotton or a minutely perforated film (A) having a melting point which is at least 5° C. lower than those of other resin layers.

When the protrudent hole-forming portions are provided on a resin film in accordance with the method of the third embodiment of the invention, heating the resin film on the metallic cylinder or porous plate to such a temperature that the resin of the outermost layer of the resin film is melted while the other resin layers are softened causes joining of paper, cloth cotton or a minutely perforated film (A) with the resin film to simultaneously accomplish sticking for lamination and hole formation. Thus, a separate step for sticking for lamination can be avoided. Above all, when paper, cloth cotton or a minutely perforated film (A) is stuck to a film (B) having holes provided with protrudent hole-forming portions by a separate step, by passing them between heated rolls, the provided protrudent hole-forming portions are unfavorably likely to be collapsed. By contrast, when sticking of paper, cloth cotton or a minutely perforated film (A) is carried out simultaneously with hole formation on a metallic cylinder or porous plate in accordance with the invention of the third embodiment of the invention, the sticking can be accomplished without the collapsing of the protrudent hole-forming portions.

Accordingly, a fourth embodiment of the invention is directed to a resin film comprising a plurality of resin layers different from each other, the resin of an outermost layer having a melting point which is at least 5° C. lower than those of other resin layers.

Further, a fifth embodiment of the invention relates to a method of producing a bag for packing powder, which method comprises the steps of:

using a composite sheet, which is obtained by laminating the film (B) having holes obtained by the fourth embodiment of the invention with any of paper, cloth cotton or a minutely perforated film (A), and forming said composite sheet into a bag in such a manner that the protrudent hole-forming portions of the film (B) having holes are directed inwards.

Still further, a sixth embodiment of the invention relates to a bag for packing powder produced by using a composite sheet, which is obtained by laminating the film (B) having holes obtained by the method of embodiments 3 or 4 with any of paper, cloth cotton or a minutely perforated film (A), and forming said composite sheet into a bag in such a manner that the protrudent hole-forming portions of the film (B) having holes are directed inwards.

In the seventh preferred embodiment of the invention, the bag for packing powder is produced by using a composite sheet of triple layer structure, which is obtained by disposing the film (B) having holes obtained by the method of embodiments 3 or 4, arranged inside, and a minutely perforated film (A), arranged outside, and interposing paper-or cloth cotton therebetween, and forming the composite sheet into a bag in such a manner that the protrudent hole-forming portions of the film (B) having holes are directed inwards.

Furthermore, the eighth embodiment of the invention relates to a bag for packing powder, which is produced by using a composite sheet of triple layer structure, which is obtained by laminating the film (B) having holes obtained by the method of embodiments 3 or 4, with both sides of any of paper, cloth cotton and a minutely perforated film (A), and forming the composite sheet into a bag.

Figure 6:
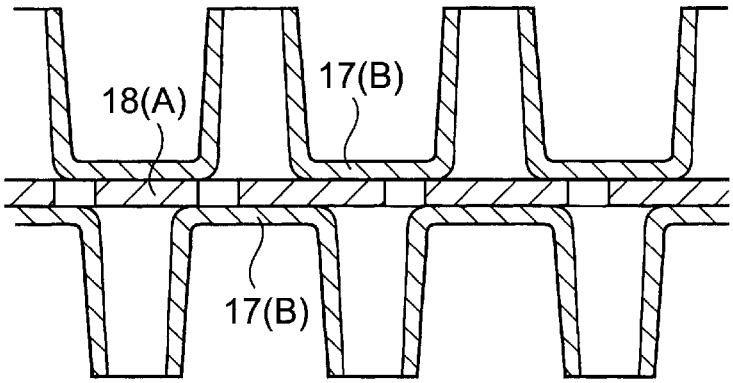
FIG. 6 is a sectional view of a composite sheet having both sides thereof composed of films provided with protrudent hole-forming portions.

The bag must be formed with paying attention to the front or back of the sheet so that the protrudent hole-forming portions are directed inwards in the bag formation from a sheet with its one side only provided with the protrudent hole-forming portions. On the contrary to this, efficiency of bag formation is enhanced in the invention in which, as shown in FIG. 6, both the front and back of minutely perforated film (A) 18 are laminated with films (B) having holes 17. Because the bag formation can be effected with the protrudent hole-forming portions directed inwards irrespective of which side, front or back, of the composite sheet is employed. Moreover, any film provided with the protrudent hole-forming portions is unidirectional with respect to the passage of water or dust, that is, the penetration of water or dust is easy from the flat side but difficult from the side of protrudent hole-forming portions. Therefore, the penetration of water or dust into the bag formed so as to have its both sides furnished with the protrudent hole-forming portions can be restrained.

With respect to the film (B) having holes and minutely perforated film (A) used in the above inventions, the spacing of hole-forming portions or hole spacing is generally in the range of 0.8 to 10 mm.

The cloth cotton employed in the above inventions is not particularly limited and may have any arbitrary form, for example, the form of woven fabric, knitted fabric, non-woven fabric or net sheet.

The material from which the minutely perforated film (A) or (B) film having holes provided with protrudent hole-forming portions employed in the above inventions is prepared can be, for example, an olefinic synthetic resin such as low-density polyethylene, high-density polyethylene, polypropylene, poly-1-butene, poly-4-methyl-1-pentene or polyethylene. The material can also be a random or block copolymer of α-olefins such as propylene, 1-butene and 4-methyl-1-pentene. Further, the material can be an ethylene/vinyl compound copolymer such as ethylene/acrylic acid copolymer, ethylene/vinyl acetate copolymer, ethylene/vinyl alcohol copolymer or ethylene/vinyl chloride copolymer; a styrene resin such as polystyrene, acrylonitrile/styrene copolymer, acrylonitrile/butadiene/styrene copolymer, methyl methacrylate/styrene copolymer or α-methylstyrene/styrene copolymer; a vinyl chloride resin such as polyvinyl chloride, polyvinylidene chloride or vinyl chloride/vinylidene chloride copolymer; or a polyacrylic acid ester such as polymethyl acrylate or polymethyl methacrylate. Still further, the material can be a polyamide such as nylon-6, nylon-6,6, nylon-6,10, nylon-11 or nylon-12; a non-polyamide thermoplastic polyester such as polyethylene terephthalate or polybutylene terephthalate; or polycarbonate or polyphenylene oxide. These may be used either individually or in combination.

It is preferred that the thickness (d) of the minutely perforated film (A) or film (B) having holes employed in the present invention is in the range of 5 to 200 μm, especially 10 to 100 μm, as aforementioned. The minutely perforated film (A) and film (B) having holes may be oriented in uniaxial or biaxial direction or may remain unoriented.

The film perforation for obtaining the minutely perforated film (A) can be accomplished, for example, by passing a film between a heated cylindrical pin roll provided with a plurality of protrudent needles and a projected roll fitted with projected disc so as to form holes. Alternatively, the film perforation can be accomplished by drawing a film or sheet of a resin composition comprising a polyethylene resin, a wax based on saturated hydrocarbon compound and a filler of cellulose powder to thereby form minute holes, as described in Japanese Patent Laid-open Publication No. 8(1996)-245818.

The powder packed in the packing bag according to each of the above inventions can be, for example, an oxygen scavenger composed of an oxygen adsorbing substance, a carbon dioxide release agent composed of a substance capable of releasing carbon dioxide, a moisture absorbent agent including calcium oxide or silica gel, a fragrance preparation including wood powder or the like, a cosmetic powder, a carbon dioxide adsorbent, active carbon, iron powder, paulownia wood ash, zeolite or a highly water absorbent polymer.

Therefore, the ninth embodiment of the invention is directed to the bag for packing powder as claimed in any of embodiments 1, 2 and 6 to 8, wherein the packed powder is any of an oxygen scavenger composed of an oxygen adsorbing substance, a carbon dioxide release agent composed of a substance capable of releasing carbon dioxide, a moisture absorbent including calcium oxide or silica gel, a fragrance preparation, a cosmetic powder including wood powder or the like, a carbon dioxide adsorbent, active carbon, iron powder, paulownia wood ash, zeolite and a highly water absorbent polymer.

In the use of the packing bag according to the invention of embodiments 1 or 2, the soaring of powder at the time of powder filling can be prevented to thereby facilitate the filling operation. Furthermore, the sticking of powder to seal portion is reduced at the time of sealing the mouth of the bag to thereby ensure obtaining satisfactory seal strength. Moreover, the environmental pollution by the soaring of powder can be avoided.

The method according to the invention of embodiment 3 enables not only easily producing the film (B) having holes provided with protrudent hole-forming portions by a one-step process. Furthermore, the hole size and the hole spacing can be reduced and further uniformalizing of the configuration of each hole can be obtained.

When the film (B) having holes obtained by the method according to the invention of embodiment 4 is heated and laminated with any of paper, cloth cotton and a minutely perforated film (A), it is feasible to combine them by sticking to each other simultaneously with the hole formation without collapsing the provided protrudent hole-forming portions. Thus, the method according to the invention of embodiment 5 enables forming the composite sheet provided with protrudent hole-forming portions, which has easily been obtained by the invention of embodiment 4, into a packing bag.

The packing bag according to the invention of claim 2 exhibits an increased strength because of the lamination with any of paper, cloth cotton and a minutely perforated film (A). Moreover, although spilling of packed powder may be experienced with the employment of a single-layer structure, such spilling of powder can be avoided by the employment of plural-layer structure. Further, the gas permeability thereof can be adjusted in conformity with the purpose of the packing bag.

In the use of the packing bag according to the invention of embodiment 7, not only can the same effects as in the invention of embodiment 4 be exerted, but also the soaring of powder at the time of powder filling can be prevented to thereby facilitate the filling operation, satisfactory seal strength can be obtained and environmental pollution can be prevented.

When, like the packing bag according to the invention of embodiment 8, a packing bag is produced from the composite sheet comprising a minutely perforated film (A) having its both sides laminated with films (B) having holes provided with protrudent hole-forming portions, the bag production can be performed without attention to the front or back of the composite sheet to thereby enhance operation efficiency. Furthermore, not only spilling of the packed powder out of the bag but also the penetration of water or dust from outside can be restrained by virtue of the presence of protrudent hole-forming portions both outside and inside.

The packing bag according to the invention of claim 5 facilitates filling of powder such as an oxygen scavenger, a carbon dioxide release agent, a moisture absorbent, a fragrance preparation, a cosmetic powder, a carbon dioxide adsorbent, active carbon, iron powder, paulownia wood ash, zeolite or a highly water absorbent polymer and enables preventing the soaring thereof at the time of filling, so that the size of the packing bag can be reduced.

EXAMPLE 1

Figure 7:
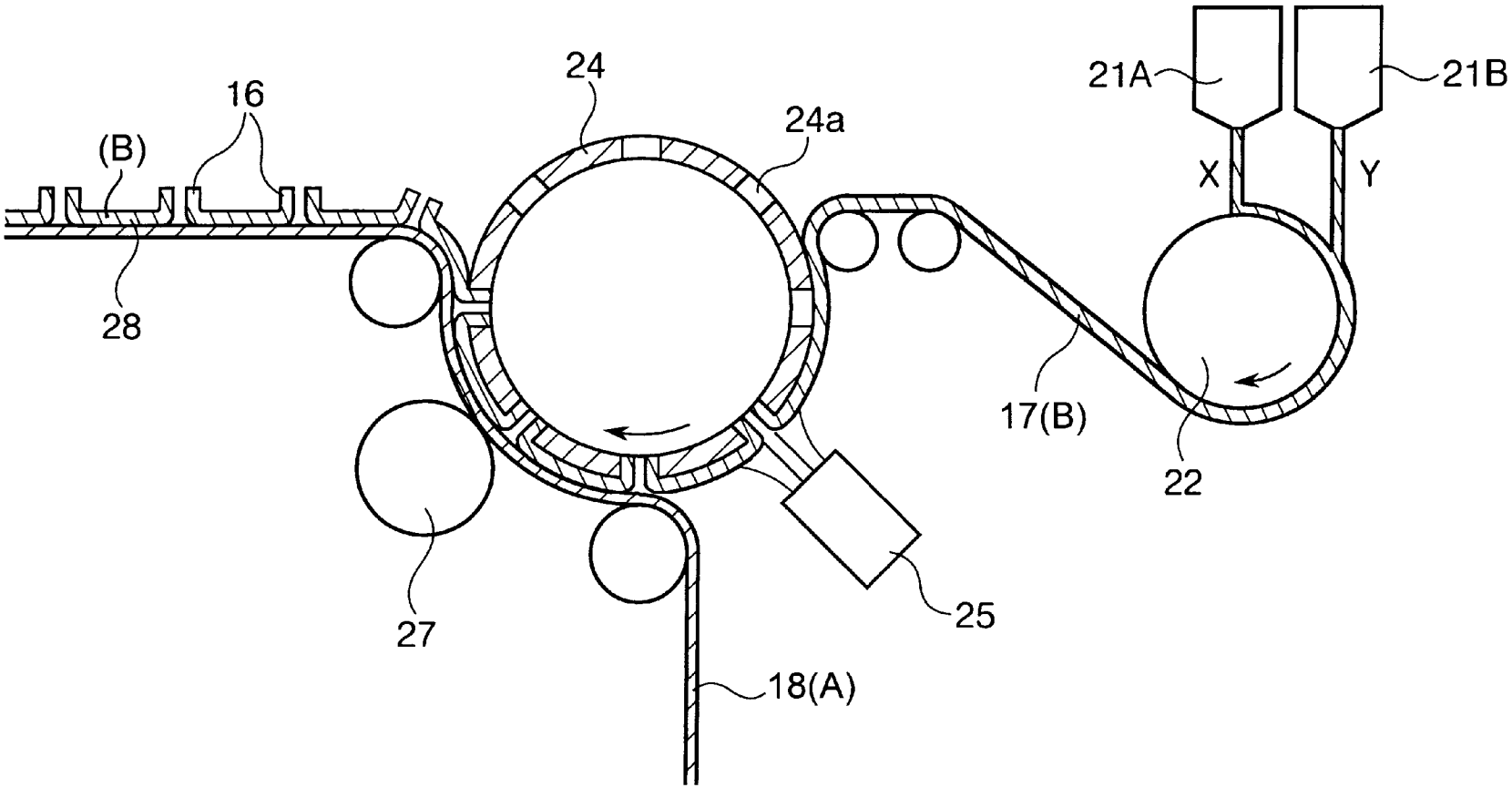
FIG. 7 is a schematic diagram of an apparatus for use in the production of a composite sheet provided with protrudent hole-forming portions.

Low-density polyethylene X of 7 g/10 min melt index, 0.917 g/cm$^3$ density and 106° C. melting point and low-density polyethylene Y of 8 g/10 min melt index, 0.925 g/cm$^3$ density and 120° C. melting point were extruded by the use of, as shown in FIG. 7, single-screw extruders respectively having slit dies 21A and 21B at distal ends thereof at a resin temperature of 200° C. The extrudates were taken up on cooling roll 22 maintained at 20° C. Thus, cast film (B) 17 of 30 $\mu$m thickness was formed.

The obtained film (B) 17 was continuously fed onto metallic cylinder 24 of 0.4 mm thickness having openings 24*a* of 2 mm diameter and 5 mm center-to-center distance pitch provided over the entire surface thereof. While rotating the metallic cylinder, hot air of 360° C. generated by hot air blower 25 was blown onto the film (B) 17 so that the resin X of an outer layer was softened and the resin Y of an inner layer was melted. Simultaneously, the inner side of the metallic cylinder was sucked by a vacuum pump.

Paper, cloth cotton or minutely perforated film (A) 18 was fed onto the cast film round the metallic cylinder 24, compression bonded by means of press roll 27 and taken up by winding. Thus, composite sheet 28 provided with protrudent hole-forming portions 16 having a sectional configuration shown in FIG. 4 was obtained.

The height of protrusions of the protrudent hole-forming portions 16 of the film (B) of the composite sheet 28 was 500 $\mu$m.

Figure 8:
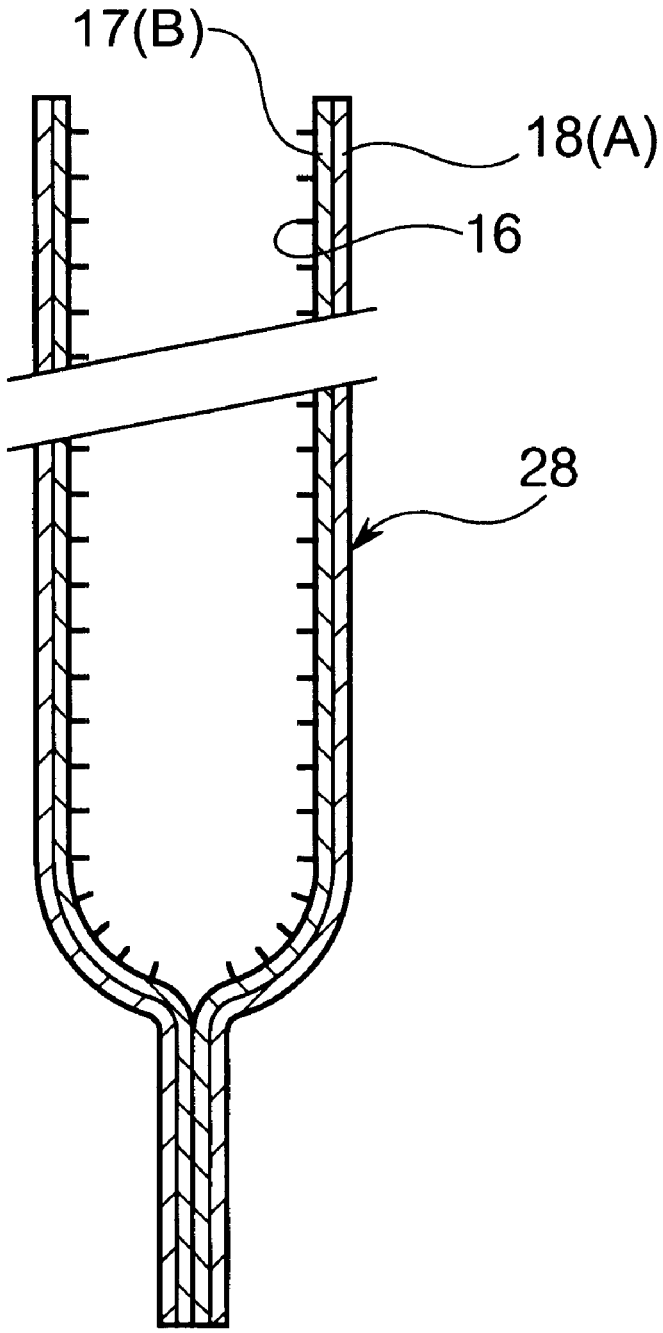
FIG. 8 is a schematic sectional view of one form of packing bag of the present invention.

The resultant composite sheet 28 was set in an automatic packing machine in such a manner that the side of film (B) 17 provided with protrudent hole-forming portions was directed inwards, thereby producing packing bags having a sectional configuration shown in FIG. 8. Individual packing at a 50 mm length and a 40 mm width in bag inside dimension was carried out by packing the bags with finely particulate iron powder, and the degree of soaring of powder at the time of packing was inspected.

The degree of soaring of powder was evaluated on the basis of the degree of intrusion of powder into seal portion at an upper end of each of the bags as follows:

○: no or substantially no intrusion of powder into the seal portion was observed, so that satisfactory seal strength was exhibited;

Δ: some powder intrusion was observed, but there was no lowering of seal strength observed; and ×: much powder intrusion was observed, and there was a lowering of seal strength observed.

Comparative Example 1

Cast film of 30 $\mu$m thickness was formed in the same manner as in Example 1. The cast film was perforated by means of a heated cylindrical pin roll provided with a multiplicity of protrudent needles of 2 mm diameter and 5 mm center-to-center distance pitch in streaks.

The perforated film was laminated with paper in the same manner as in Example 1, thereby obtaining a composite sheet. There was no protrudent hole-forming portion on this composite sheet.

Individual packing was performed with the use of this composite sheet in the same manner as in Example 1, and the degree of soaring of powder was evaluated.

The obtained results are given in Table 1.

TABLE 1

| | Results of evaluation on degree of powder soaring | |
|---|---|---|
| | Amt. of iron powder (g) | Degree of soaring |
| Example 1 | 1 | ○ |
| | 2 | ○ |
| | 3 | ○-Δ |
| | 4 | ○-Δ |
| Comp. Ex. 1 | 1 | ○ |
| | 2 | Δ |
| | 3 | X |
| | 4 | X |

What is claimed is:

1. A method of producing a bag for packing powder, comprising the steps of:

using a composite sheet, said composite sheet being obtained by laminating film (B) having holes with any of paper, cloth cotton or minutely perforated film (A), said film (B) having holes obtained by disposing a resin film on a metallic cylinder or porous plate furnished with a plurality of openings, and applying a negative pressure suction to the resin film from a back of the metallic cylinder or porous plate, while heating the resin film at its softening point or higher, so that the resin film at the openings is drawn toward the back of the metallic cylinder or porous plate to thereby provide protrudent hole-forming portions wherein said resin film comprises a plurality of resin layers different from each other, the resin of an outermost layer having a melting point which is at least 5° C. lower than those of other resin layers, and forming said composite sheet into a bag in such a manner that the protrudent hole-forming portions of the film (B) having holes are directed inwards.

2. A bag for packing powder produced by using a composite sheet, said composite sheet being obtained by laminating film (B) having holes with any of paper, cloth cotton or minutely perforated film (A), said film (B) having holes obtained by disposing a resin film on a metallic cylinder or porous plate furnished with a plurality of openings, and applying a negative pressure suction to the resin film from a back of the metallic cylinder or porous plate, while heating the resin film at its softening point or higher, so that the resin film at the openings is drawn toward the back of the metallic cylinder or porous plate to thereby provide protrudent hole-forming portions, and forming said composite sheet into a bag in such a manner that the protrudent hole-forming portions of the film (B) having holes are directed inwards.

3. A bag for packing powder produced by using a composite sheet of triple layer structure, said composite sheet being obtained by disposing the film (B) having holes obtained by disposing a resin film on a metallic cylinder or porous plate furnished with a plurality of openings, and applying a negative pressure suction to the resin film from a back of the metallic cylinder or porous plate, while heating the resin film at its softening point or higher, so that the resin film at the openings is drawn toward the back of the metallic cylinder or porous plate to thereby provide protrudent hole-forming portions, said film (B) having holes arranged inside, and a minutely perforated film (A), arranged outside, and interposing paper or cloth cotton therebetween, and forming the composite sheet into a bag in such a manner that the protrudent hole-forming portions of the film (B) having holes are directed inwards.

4. A bag for packing powder produced by using a composite sheet of triple layer structure, said composite sheet being obtained by laminating the film (B) having holes with both sides of any of paper, cloth cotton or minutely perforated film (A), said film (B) having holes obtained by disposing a resin film on a metallic cylinder or porous plate furnished with a plurality of openings, and applying a negative pressure suction to the resin film from a back of the metallic cylinder or porous plate, while heating the resin film at its softening point or higher, so that the resin film at the openings is drawn toward the back of the metallic cylinder or porous plate to thereby provide protrudent hole-forming portions, and forming the composite sheet into a bag.

5. The bag for packing powder as claimed in claims 1, 2, 3 or 4 wherein said packing powder is any of an oxygen scavenger composed of an oxygen adsorbing substance, a carbon dioxide release agent composed of a substance capable of releasing carbon dioxide, a moisture absorbent including calcium oxide or silica gel, a fragrance preparation, a cosmetic powder, a carbon dioxide adsorbent, active carbon, iron powder, paulownia wood ash, zeolite and a highly water absorbent polymer.

* * * * *